US008428449B2

(12) United States Patent
Mulder et al.

(10) Patent No.: US 8,428,449 B2
(45) Date of Patent: Apr. 23, 2013

(54) METHOD OF OPERATING A FLOW-THROUGH HEATING

(75) Inventors: Bernardo Arnoldus Mulder, Drachten (NL); Thijs De Haan, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 897 days.

(21) Appl. No.: 11/722,164

(22) PCT Filed: Dec. 15, 2005

(86) PCT No.: PCT/IB2005/054256
§ 371 (c)(1),
(2), (4) Date: Oct. 7, 2009

(87) PCT Pub. No.: WO2006/067695
PCT Pub. Date: Jun. 29, 2006

(65) Prior Publication Data

US 2010/0021149 A1 Jan. 28, 2010

(30) Foreign Application Priority Data

Dec. 20, 2004 (EP) ..... 04106710

(51) Int. Cl.
*A47J 31/00* (2006.01)

(52) U.S. Cl.
USPC ..... 392/466; 392/465; 392/479

(58) Field of Classification Search ..... 392/465–496
See application file for complete search history.

(56) References Cited

U.S. PATENT DOCUMENTS

| | | | | |
|---|---|---|---|---|
| 4,334,141 | A | 6/1982 | Roller et al. | |
| 4,949,627 | A | 8/1990 | Ricoh | |
| 5,216,743 | A * | 6/1993 | Seitz | 392/490 |
| 5,438,914 | A | 8/1995 | Hohn et al. | |
| 6,080,971 | A | 6/2000 | Seitz et al. | |
| 6,600,875 | B2 * | 7/2003 | Kodden et al. | 392/471 |
| 7,616,873 | B1 * | 11/2009 | Seitz | 392/490 |
| 2002/0051632 | A1 | 5/2002 | Kodden et al. | |

FOREIGN PATENT DOCUMENTS

| | | |
|---|---|---|
| DE | 3703889 A1 | 8/1988 |
| DE | 4444322 A1 | 6/1995 |

(Continued)

OTHER PUBLICATIONS

Harris David M et al: "Pulsed ND:YAG Laser Selective Ablation of Surface Enamel Caries: I. Photoacoustic Response and FTIR Spectroscopy" Proc SPIE Int Opt Eng; Proceedings of SPIE—The International Society for Optical Engineering 2000 Society of Photo-Optical Instrumentation Engineers, Bellingham, WA, USA vol. 3910, 2000, pp. 164-170.

(Continued)

*Primary Examiner* — Thor Campbell

(57) ABSTRACT

A flow-through heating system (1) is described, comprising: a flow tube (11); a plurality of at least two heating elements (12A, 12B, 12C), each heating element being connected in series with a corresponding controllable switch (23 A, 23B, 23C); a control unit (30) having control outputs (33A, 33B, 33C) coupled to said controllable switches; the control unit (30) being designed to generate control signals (Sa, Sb, Sc) for opening and closing the controllable switches such that said heating system is operated at a required power (Pr) less than the power capacity (Ptot) of said heating system by operating precisely one of said heating elements at reduced power while the remaining heating elements are either operated at full power or at zero power.

24 Claims, 6 Drawing Sheets

FOREIGN PATENT DOCUMENTS

| | | | |
|---|---|---|---|
| EP | 294580 | A1 | 12/1988 |
| EP | 1380243 | A1 | 1/2004 |
| JP | 55126988 | A | 10/1980 |
| JP | 6076923 | A | 3/1994 |
| JP | 6301430 | A | 10/1994 |
| JP | 2004510943 | A | 4/2004 |
| NL | 1002229 | C2 | 8/1997 |

OTHER PUBLICATIONS

Grad Ladislav et al: "Optoacoustic Studies of ER:YAG Laser Ablation in Hard Dental Tissue" Proc SPIE Int Soc Opt Eng; Proceedings of SPIE—The International Society for Optical Engineerings 1994 Society of Photo-Optical Instrumentation Engineers, Bellingham, WA, USA vol. 2128, 1994, pp. 456-465.

* cited by examiner

METHOD OF OPERATING A FLOW-THROUGH HEATING

The present invention relates in general to a heating system for heating a fluid such as water. The present invention relates particularly to a method of operating a heating system of the flow-through type, wherein the fluid to be heated flows through a tube which is provided with one or more heating elements. Such a heating system is particularly useful for application in machines for dispensing hot water for making a hot drink such as coffee, or for producing steam for frothing milk for instance in a domestic appliance.

In hot water dispensing machines, it is desired that a reasonable amount of water is brought to an elevated temperature, typically close to boiling point, within a relatively short time, which requires a relatively high power, typically of the order of about 2000-2500 W. These machines generally comprise resistive heating elements electrically powered from the public mains (i.e. 230 V AC 50 Hz in Europe), and this specifically applies to household appliances. A 2500 W apparatus requires more than 10 A current from this mains.

It is possible that the required power varies in time. For example, it may be required to have more power available when the apparatus is switched on while cold, in order to boost the heating process and produce hot water or steam as quickly as possible. When the heating process is underway, the power requirement may be lower. The heating system must be designed to cope with the maximum possible power requirement, and, to allow for tolerances, the heating system is typically rated somewhat higher than the maximum expected power requirement. In practice, however, it may be required to operate the heating system at a reduced power.

Reducing the heating power output of the heating system can be achieved by reducing the amplitude of the current in the heating element in that a power-dissipating resistor is connected in series with the heating element, but this is a waste of energy.

A more suitable method of reducing the heating power output of the heating system is to switch the current through the heating element ON and OFF.

Reducing the power consumed by a mains-operated load through switching of the current is known per se. A suitable switching method is, for example, the so-called "multi-cycle burst" method, where the switching is done at the zero-crossings of the mains, so that the current in the load always has a waveform comprising an integer number of half-waves.

When the current drawn from the mains is switched, the problem arises of how distortions of the mains should be prevented. For example, repetitive variations of the current drawn from the mains may cause local variations of the mains voltage ("flicker"), which could violate regulations.

A general aim of the present invention is to eliminate or at least reduce these problems.

It is noted that German Offenlegungsschrift 37.03.889 discloses a flow-through heating system comprising two heating elements which are operated fully ON or fully OFF independently of each other.

It is further noted that U.S. Pat. No. 5,438,914 discloses an electrical heating system for a toaster comprising two or more heating resistors which are switched such that at any time always one heating resistor is ON while all other resistors are OFF.

According to a first aspect of the present invention, the heating system comprises a plurality of at least two heating elements, substantially equal to each other, which are electrically and physically arranged in parallel to each other.

According to a second aspect of the present invention, only a maximum of one heating element is operated at reduced power at any time by being switched ON/OFF in accordance with a suitable switching scheme, while all other elements are either fully ON or fully OFF. Thus, "flicker" and similar problems relating to load switching are reduced because the magnitude of the current to be switched is reduced.

As a consequence, the heating elements may show differences in temperature: the heating element which is being operated at reduced power will have a lower temperature than the elements which are fully ON and will have a higher temperature than the elements which are fully OFF. This may result in thermal stresses. Furthermore, the heating element which is being operated at reduced power, because of being switched ON/OFF repeatedly, may suffer more and may show a reduced life expectancy compared with heating elements which are fully ON or fully OFF. According to a preferred aspect of the present invention, these consequences are reduced or even eliminated by having the status of the elements rotated as a function of time, so that, on average, each element is fully ON, fully OFF, and operated at reduced power for the same length of time.

These and other aspects, features and advantages of the present invention will be further explained by the following description with reference to the drawings, in which same reference numerals indicate same or similar parts, and in which:

FIG. 1A schematically shows a heating unit;

Figure 4A:
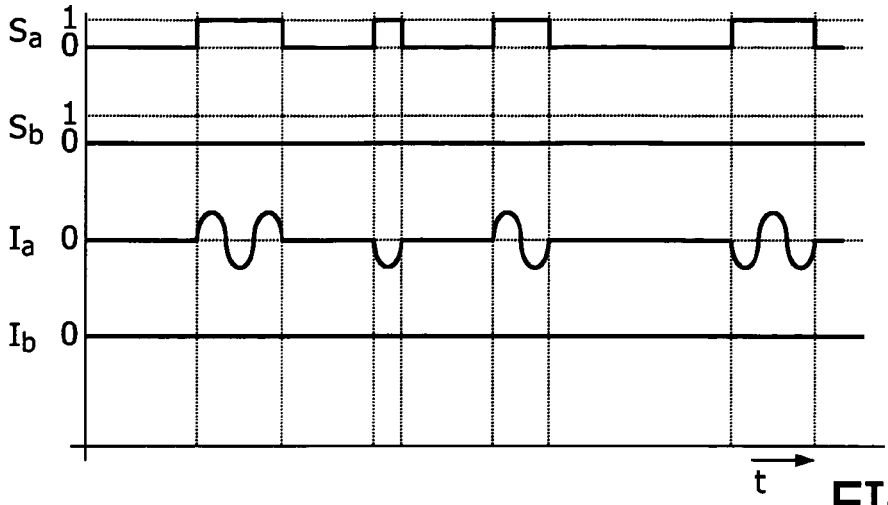
Figure 4B:
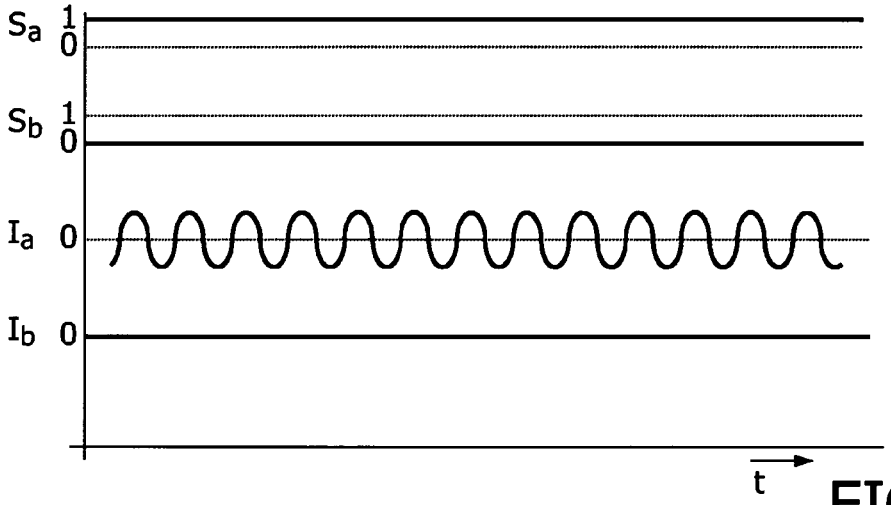
Figure 4C:
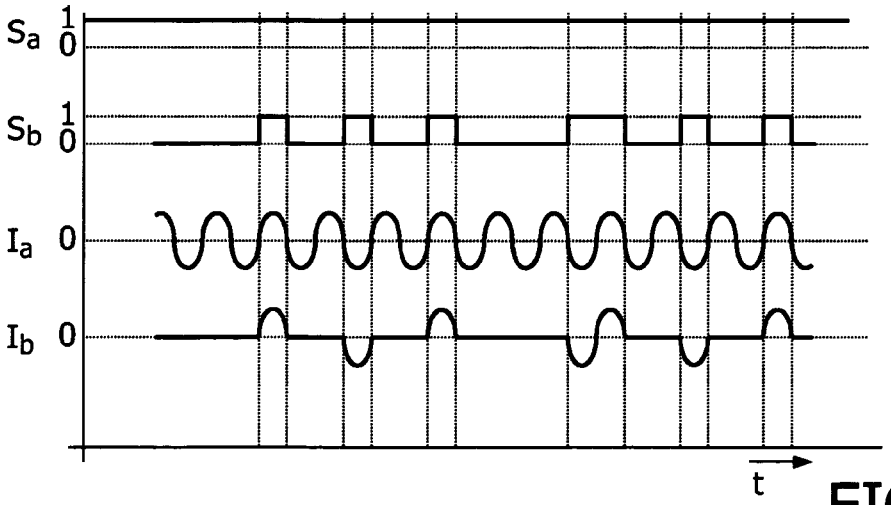
Figure 5A:
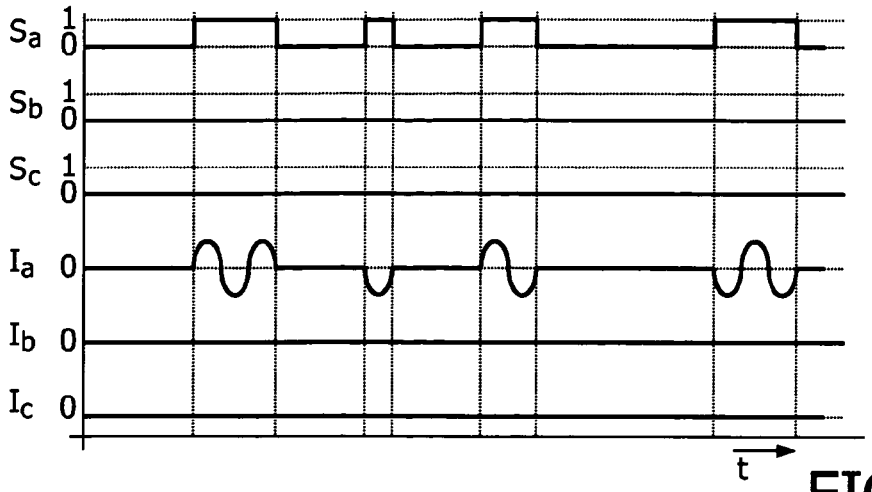
Figure 5B:
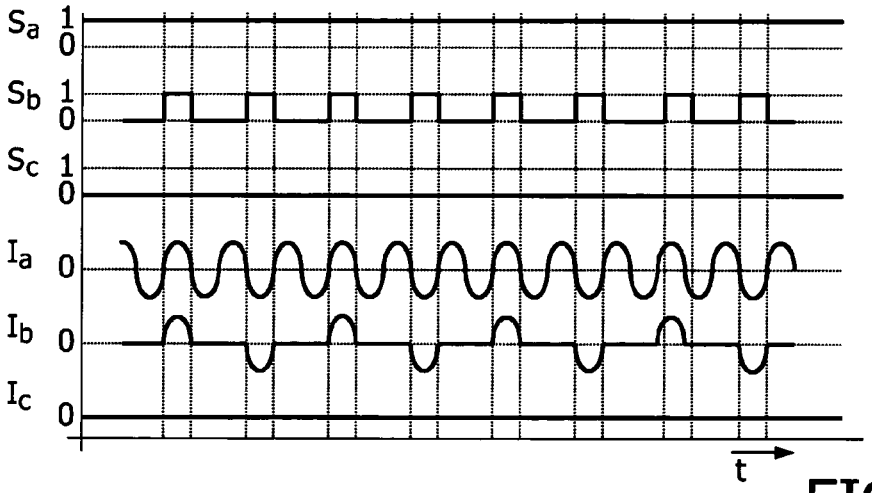
Figure 5C:
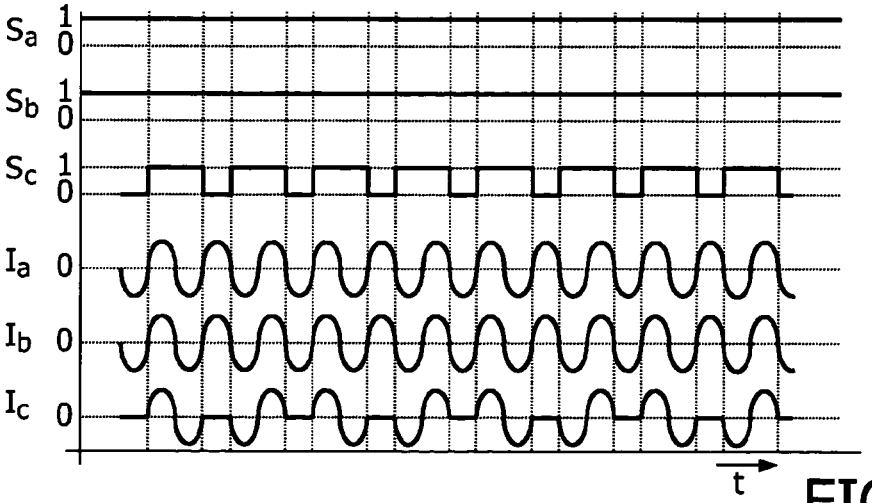
Figure 6A:
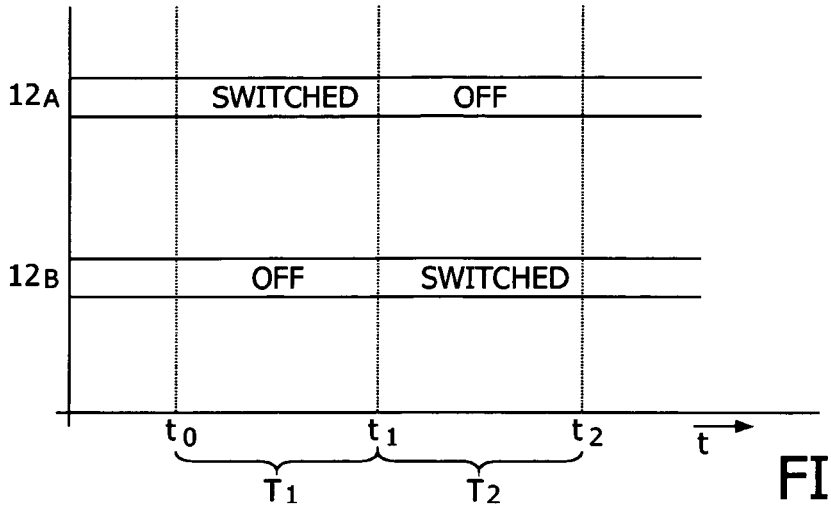
Figure 6B:
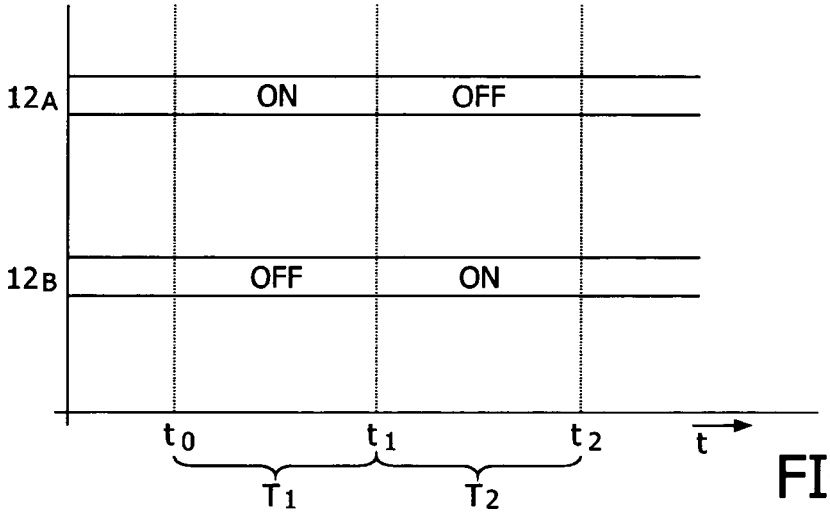
Figure 6C:
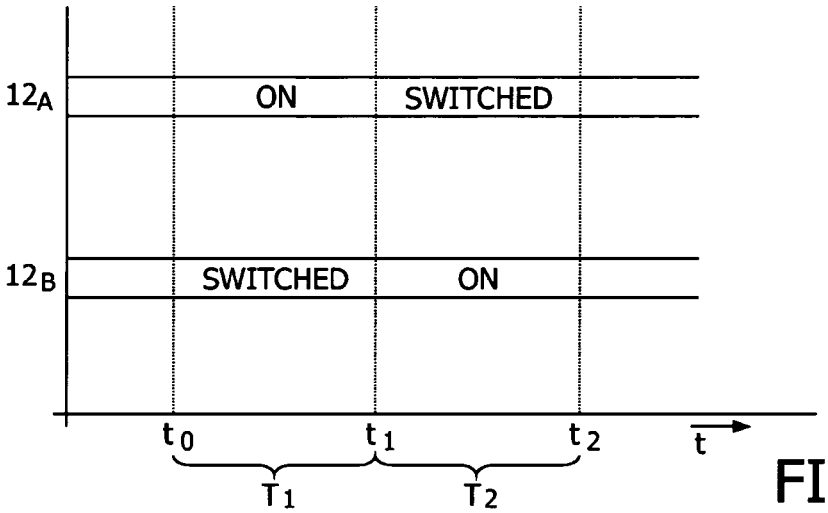
Figure 7A:
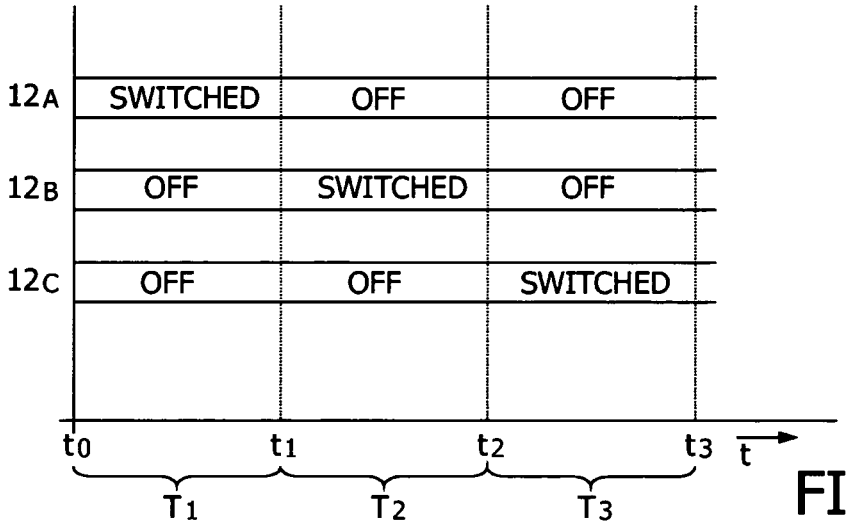
Figure 7B:
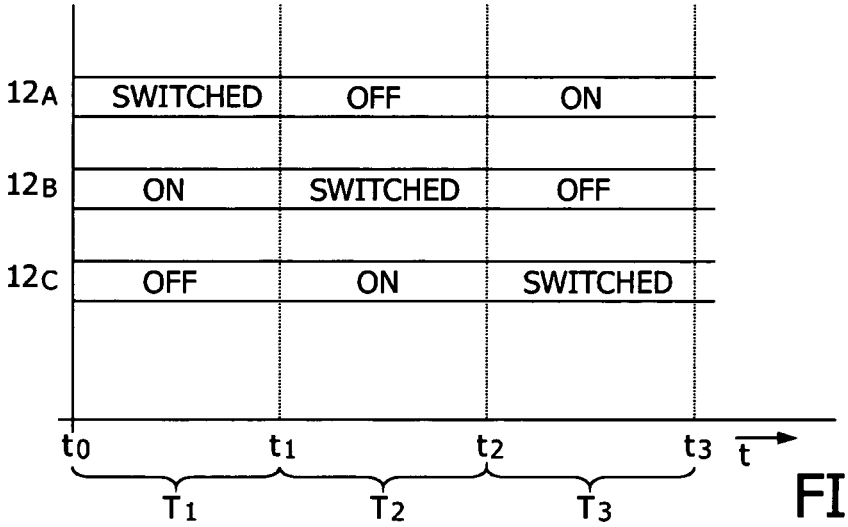
Figure 7C:
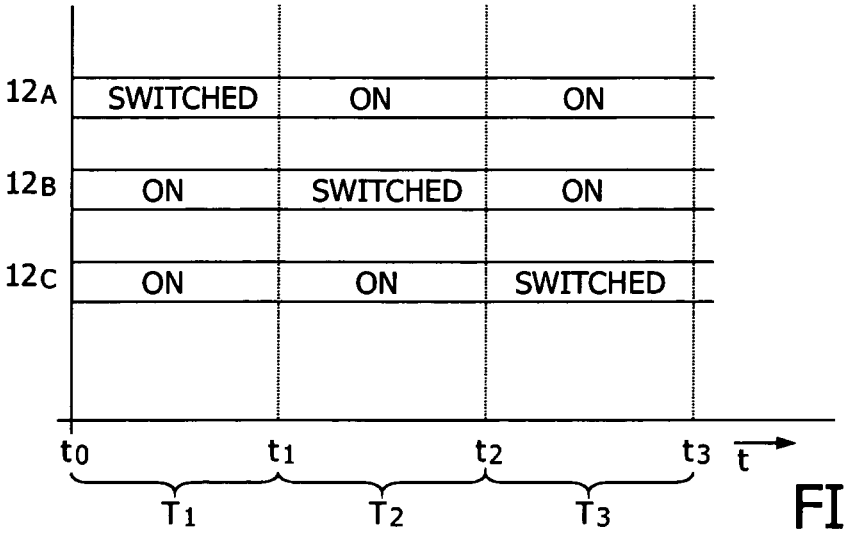

FIGS. 4A-C are time graphs illustrating the operation of the heating system having two heating elements according to the present invention, at different levels of required power;

FIGS. 5A-C are time graphs illustrating the operation of the heating system having three heating elements according to the present invention, at different levels of required power;

FIGS. 6A-C are timing charts illustrating the operation of the heating system having two heating elements according to the present invention, at different levels of required power, on a larger time scale than in FIGS. 4A-C;

FIGS. 7A-C are timing charts illustrating the operation of the heating system having three heating elements according to the present invention, at different levels of required power, on a larger time scale than in FIGS. 5A-C.

Figure 1A:
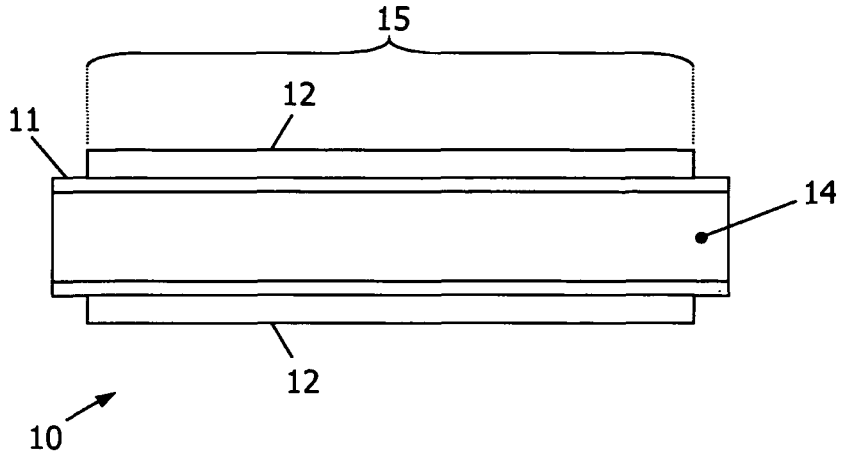
FIG. 1B is a schematic cross-section of a heating unit having two heating elements.
FIG. 1C is a schematic cross-section of a heating unit having three heating elements.

FIG. 1A schematically shows a side view of a flow-through heating unit 10, comprising a flow tube 11 and a plurality of heating elements 12 which are mutually substantially identical. It is noted that the flow tube 11 may be curved, but in the drawing the flow tube is a linear tube, such that its central axis 13 is a straight line. The inner space of the tube 11, referenced 14, is suitable for passing a fluid therethrough, for example water.

In the following, the heating elements in general will be indicated by the reference numeral 12; where it is intended to distinguish individual heating elements, they will be referenced 12A, 12B, 12C, etc.

The heating elements 12 are resistive elements designed for producing heat over substantially their entire length. The heating elements 12 have electrical contact terminals at their ends for this purpose; these terminals, however, are not shown for the sake of simplicity. In order to heat the fluid in the tube 11 effectively, the heating elements 12 are in thermal contact with the flow tube 11. In a practical embodiment, the heating elements 12 may be made from aluminum, while the flow tube 11 may be made from (stainless) steel or any other suitable metal.

Each heating element 12 is a longitudinal element extending along the length of the flow tube 11. A heating element 12 may extend parallel to the tube 11, as illustrated, or a heating element 12 may alternatively extend as a helix around the tube 11. In any case, a heating element 12 is mounted for heating a certain segment 15 of the length of the tube 11. The heating elements 12 may have the same axial length as the flow tube 11, or they may alternatively be shorter, in which case the heated tube segment 15 will be shorter than the entire tube 11.

Figure 1B:
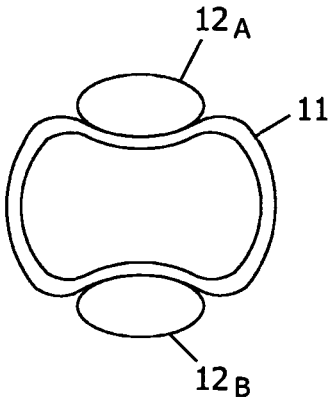
Figure 1C:
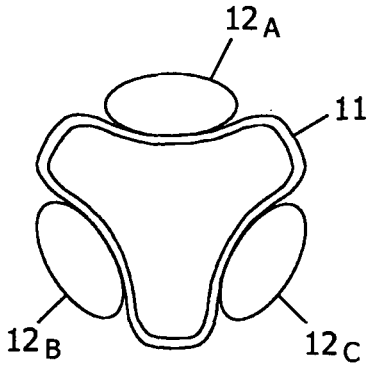

The multiple heating elements 12A, 12B, 12C are arranged around the tube 11, extending substantially parallel to each other and associated with the same segment 15. Or, to put it differently, the tube segment 15 is heated by multiple heating elements 12; the heat input into the tube segment 15 being the sum of the heat contributions of the individual heating elements. FIG. 1B is a schematic cross-section of the heating unit 10 in the case of an embodiment having two heating elements 12A, 12B arranged opposite to each other. FIG. 1C is a schematic cross-section of the heating unit 10 in the case of an embodiment having three heating elements 12A, 12B, 12C at distances of 120° from each other. It should be clear that embodiments having four or more heating elements are feasible, too.

The flow tube 11 may have a circular cross-section, or the flow tube 11 may alternatively have an undulating cross section, showing convex portions and concave portions, the heating elements being arranged in the latter, as shown.

Figure 2:
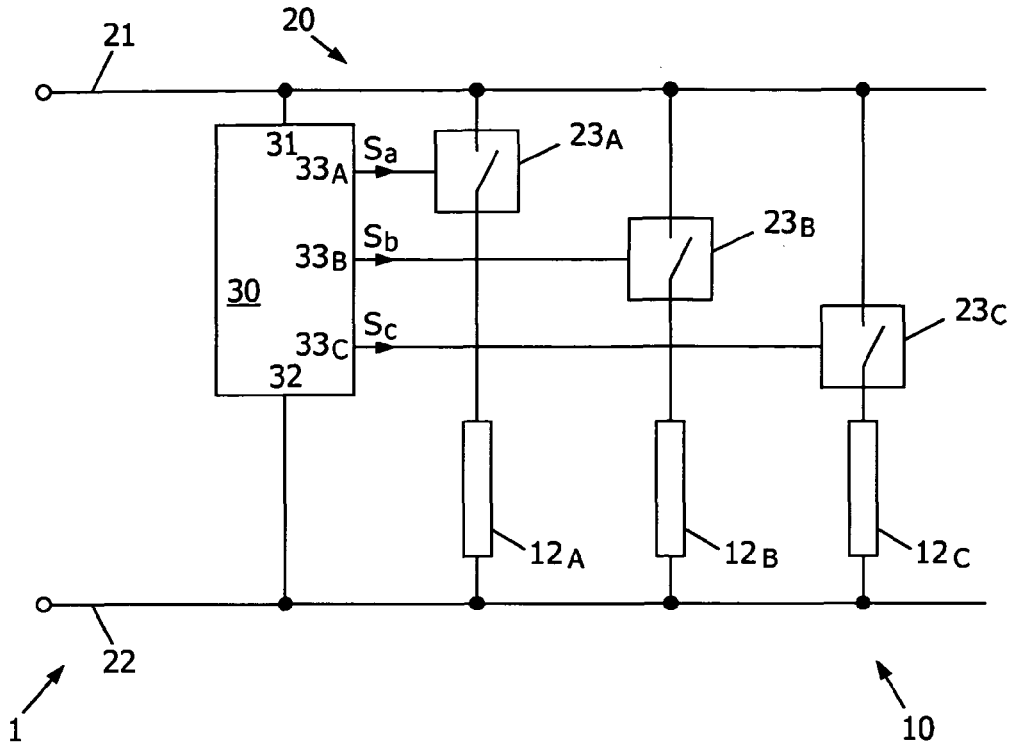
FIG. 2 is a block diagram schematically illustrating the electrical operation of a heating system.

FIG. 2 is a circuit diagram of a flow-through heating system 1, comprising the heating unit 10 and a power circuit 20 for powering the heating elements 12 in an embodiment in which the heating system has three heating elements. Modifications to this circuit for a heating system having two heating elements, or having four or more elements, should be clear to those skilled in the art.

The power circuit 20 comprises two power lines 21 and 22 designed for being connected to the mains in a manner known per se. Thus, the power lines 21 and 22 may carry, for example, a 230 V AC voltage at 50 Hz. Each heating element 12 is connected between the two power lines 21 and 22, so that the current in the power lines 21 and 22 is the sum of the individual currents in the individual heating elements. Each heating element has its controllable switch 23 connected in series with it. In the following, individual switches will be indicated by reference numerals 23A, 23B, 23C, etc. By way of example, the switches 23 may be implemented as triacs, but other suitable types of switches may be used as well, as will be clear to those skilled in the art.

The power circuit 20 further comprises a control unit 30, having power inputs 31, 32 connected to the power lines 21, 22 for receiving operational power, and having control outputs 33A, 33B, 33C coupled to the respective controllable switches 23A, 23B, 23C. The control unit 30 is designed to generate control signals Sa, Sb, Sc for the controllable switches 23A, 23B, 23C, respectively, such that the corresponding heating elements are either operated at 100% heating power, zero power, or reduced power, as will be explained hereinafter.

Each heating element 12 has a power rating P. The overall power capacity Ptot of the heating system is equal to the sum of the individual power ratings Pi of the individual heating elements 12*i*, expressed as $Ptot=\Sigma Pi$. Assuming that the heating elements are mutually substantially identical, the overall power capacity Ptot of the heating system is equal to N×P, N being the number of heating elements.

If the required heating power Pr at a certain moment in time is equal to Ptot, all heating elements 12 should be switched on fully. If the required heating power Pr at a certain moment in time is less than Ptot, one of the heating elements 12 should be operated at reduced power. In order to operate a heating element 12 at reduced power, the corresponding controllable switch 23 is controlled to be switched ON (conductive) and OFF (non-conductive) at regular moments in time, preferably coinciding with zero-crossings of the current, in which case the resulting current in the heating element is a sequence of half-waves. Such a sequence is denoted a "multi-cycle burst mode". An example of the resulting current pattern is illustrated in FIG. 3.

Figure 3:
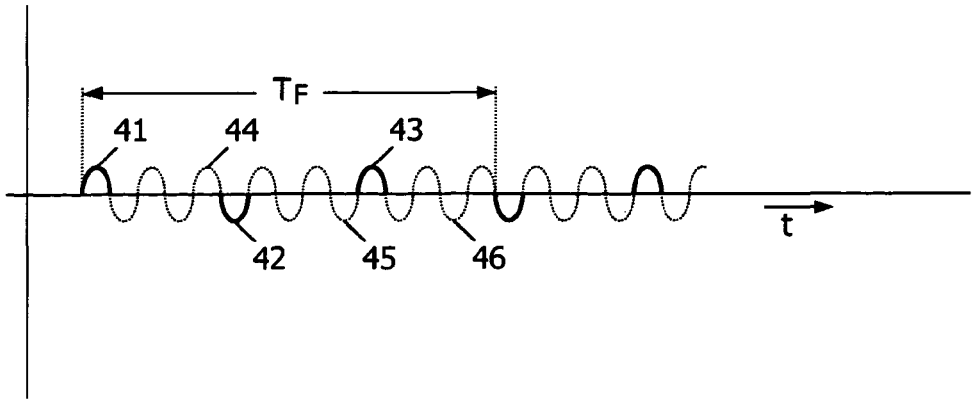
FIG. 3 is a time graph schematically illustrating reduced power operation suitable for implementing the present invention.

FIG. 3 shows an exemplary time frame TF of 150 ms, corresponding to 15 half-cycles at 50 Hz. In this time frame, a switch is ON during half-cycles 1, 6, 11, indicated by solid curves 41, 42, 43, and OFF during all other half-cycles, indicated by dotted curves 44, 45, 46. Thus, a corresponding heating element will produce (approximately) 3/15 of its rated power P. It should be clear that the actual level of power produced depends on the relative number of half-cycles ON.

An important aspect is the fact that, on average, the current drawn from the mains should preferably be free from any DC component. In the above example, the time frame TF comprises two positive-current half-cycles and one negative-current half-cycle, so the DC component is not equal to zero on this scale. However, the next time frame will comprise two negative-current half-cycles and one positive-current half-cycle, so the average current is free from DC on average on a time scale larger than two frames.

This DC-free effect can also be achieved if always a full current cycle is passed, i.e. the combination of a positive and a negative current half-cycle each time.

It is noted that zero-crossing switching, and multi-cycle burst mode operation, are known per se. It is further noted that other types of switching schemes for operating a heating element at reduced power may be known to those skilled in the art and may be used in implementing the present invention. In any case, a heating element which is provided with switched current so as to operate at reduced power will be indicated as a "switched" heating element.

According to an important aspect of the present invention, the control unit 30 is designed to generate its control signals Sa, Sb, Sc, etc. for the associated controllable switches 23A, 23B, 23C, etc. such that a maximum of only one heating element is operated as a "switched" heating element. All other elements are either operated at 100% heating power or at 0% heating power.

This is illustrated in FIGS. 4A-C for the case of a system comprising precisely two heating elements.

FIG. 4A is a graph showing possible control signals Sa, Sb for the controllable switches 23A, 23B and the resulting heating currents Ia, Ib in the heating elements 12A, 12B, respectively, as a function of time in a situation where the required power is more than zero but less than Ptot/2. It can be seen that the first switch 23A is switched ON and OFF so that the corresponding heating element 12A is operated as a "switched" heating element, while the second switch 23B is continuously kept in its OFF state, so that the corresponding heating element 12B is operated at 0% power.

FIG. 4B is a graph showing control signals Sa, Sb for the controllable switches 23A, 23B and resulting heating currents Ia, Ib in the heating elements 12A, 12B, respectively, in a situation where the required power is equal to Ptot/2. It can be seen that the first switch 23A is continuously kept in its ON state so that the corresponding heating element 12A is operated at 100% power, while the second switch 23B is continuously kept in its OFF state, so that the corresponding heating element 12B is operated at 0% power.

FIG. 4C is a graph showing possible control signals Sa, Sb for the controllable switches 23A, 23B and resulting heating currents Ia, Ib in the heating elements 12A, 12B, respectively, in a situation where the required power is more than Ptot/2 but less than Ptot. It can be seen that the first switch 23A is continuously kept in its ON state so that the corresponding heating element 12A is operated at 100% power, while the second switch 23B is switched ON and OFF, so that the corresponding heating element 12B is operated as a "switched" heating element.

It should be clear that in the extreme situation where the required power is equal to zero, both switches are continuously kept in their OFF state, and that in the extreme situation where the required power is equal to Ptot, both switches are continuously kept in their ON state.

This aspect of the invention is further explained in FIGS. 5A-C for the case of a system comprising precisely three heating elements.

FIG. 5A is a graph showing possible control signals Sa, Sb, Sc for the controllable switches 23A, 23B, 23C, respectively, and resulting heating currents Ia, Ib, Ic in the heating elements 12A, 12B, 12C, respectively, in a situation where the required power is less than Ptot/3. It can be seen that the first switch 23A is switched ON and OFF so that the corresponding heating element 12A is operated as a "switched" heating element, while the second and third switches 23B and 23C are kept in their OFF state continuously so that the corresponding heating elements 12B and 12C are operated at 0% power.

FIG. 5B is a graph showing possible control signals Sa, Sb, Sc for the controllable switches 23A, 23B, 23C and resulting heating currents Ia, Ib, Ic in the heating elements 12A, 12B, 12C, respectively, in a situation where the required power is more than Ptot/3 but less than 2×Ptot/3. It can be seen that the first switch 23A is continuously kept in its ON state, so that the corresponding heating element 12A is operated at 100% power, that the second switch 23B is switched ON and OFF so that the corresponding heating element 12B is operated as a "switched" heating element, and that the third switch 23C is continuously kept in its OFF state, so that the corresponding heating element 12C is operated at 0% power.

FIG. 5C is a graph showing possible control signals Sa, Sb, Sc for the controllable switches 23A, 23B, 23C and resulting heating currents Ia, Ib, Ic in the heating elements 12A, 12B, 12C, respectively, in a situation where the required power is more than 2×Ptot/3 but less than Ptot. It can be seen that the first and second switches 23A and 23B are continuously kept in their ON state, so that the corresponding heating elements 12A and 12B are operated at 100% power, and that the third switch 23C is switched ON and OFF, so that the corresponding heating element 12C is operated as a "switched" heating element.

The border situations where the required power is equal to zero, or equal to Ptot/3, or equal to 2×Ptot/3, or equal to Ptot, are not illustrated. It is noted that in these border situations no heating element is operated as a "switched" heating element, so EMC-related problems do not occur.

The control method as proposed by the present invention achieves that only one heating element is operated as a "switched" heating element in all situations apart from the border situations, while all other heating element are fully ON or fully OFF. As a result, flicker-related problems are kept to a minimum. The larger the number of heating elements in the heating system, the greater the reduction of flicker-related problems is.

If the heating elements in the heating system are not operated equally, the heating elements may experience differences in wear or thermo-mechanical stresses, or both. Furthermore, some bending of the flow tube 11 may be caused, especially if the flow tube 11 is made from a material different from the material of the heating elements 12. The above applies to the border situations, too, except, of course, to the border situations where the required power is equal to zero or equal to Ptot. In order to reduce these problems, and in order to obtain a thermally balanced system, according to a second aspect of the present invention, the functions of the individual heating elements are mutually exchanged, so that the heating elements are operated equally on average on a larger time scale.

This second aspect is illustrated in FIGS. 6A-C for the case of a system comprising precisely two heating elements.

FIG. 6A illustrates the operation of the heating elements 12A, 12B as a function of time in a situation where the required power is more than zero but less than Ptot/2 (cf FIG. 4A). During a first time interval T1 from t0 to t1, the first heating element 12A is operated as a "switched" heating element while the second heating element 12B is OFF. During a second time interval T2 from t1 to t2 having the same duration as the first time interval T1, the first heating element 12A is OFF while the second heating element 12B is operated as a "switched" heating element. Thus, at all times there is one heating element which is operated as a "switched" heating element and one heating element which is OFF, but the identity of these elements is switched. On average, over the time interval T1+T2 from t0 to t2, the first heating element 12A is operated as a "switched" heating element during 50% of the time and the second heating element 12B is also operated as a "switched" heating element during 50% of the time; so that on a larger time scale the two elements are treated equally.

FIG. 6B illustrates the operation of the heating elements 12A, 12B as a function of time in a situation where the required power is equal to Ptot/2 (cf FIG. 4B). During a first time interval T1 from t0 to t1, the first heating element 12A is ON while the second heating element 12B is OFF. During a second time interval T2 from t1 to t2 having the same duration as the first time interval T1, the first heating element 12A is OFF while the second heating element 12B is ON. Thus, at all times there is one heating element which is ON and one heating element which is OFF, but the identity of these elements is changed. On average over the time interval T1+T2 from t0 to t2, the first heating element 12A is ON during 50% of the time and the second heating element 12B is also ON during 50% of the time; so that on a larger time scale the two elements are treated equally.

FIG. 6C illustrates the operation of the heating elements 12A, 12B as a function of time in a situation where the required power is more than Ptot/2 but less than Ptot (cf. FIG. 4C). During a first time interval T1 from t0 to t1, the first heating element 12A is ON while the second heating element 12B is operated as a "switched" heating element. During a second time interval T2 from t1 to t2 having the same duration as the first time interval T1, the first heating element 12A is operated as a "switched" heating element while the second heating element 12B is ON. Thus, at all times there is one heating element which is operated as a "switched" heating element and one heating element which is ON, but the identity of these elements is changed. On average over the time interval T1+T2 from t0 to t2, the first heating element 12A is operated as a "switched" heating element during 50% of the time and is fully ON during 50% of the time, and the second heating element 12B is also operated as a "switched" heating element during 50% of the time and is fully ON during 50% of the time; so that on a larger time scale the two elements are treated equally.

This second aspect of the invention is further explained in FIGS. 7A-C for the case of a system comprising precisely three heating elements.

FIG. 7A illustrates the operation of the heating elements 12A, 12B, 12C as a function of time in a situation where the required power is more than zero but less than Ptot/3 (cf FIG. 5A). During a first time interval T1 from t0 to t1, the first heating element 12A is operated as a "switched" heating element while the second and third heating elements 12B and 12C are OFF. During a second time interval T2 from t1 to t2 having the same duration as the first time interval T1, the second heating element 12B is operated as a "switched" heating element while the first and third heating elements 12A and 12C are OFF. During a third time interval T3 from t2 to t3 having the same duration as the first time interval T1, the third heating element 12C is operated as a "switched" heating element while the first and second heating elements 12A and 12B are OFF. Thus, at all times there is one heating element which is operated as a "switched" heating element and two heating elements which are OFF, but the identity of these elements is changed. On average over the time interval T1+T2+T3 from t0 to t3, each heating element 12A, 12B, 12C is operated as a "switched" heating element during 33.3% of the time, so that on a larger time scale all elements are treated equally.

FIG. 7B illustrates the operation of the heating elements 12A, 12B, 12C as a function of time in a situation where the required power is more than Ptot/3 but less than 2×Ptot/3 (cf FIG. 5B). During a first time interval T1 from t0 to t1, the first heating element 12A is operated as a "switched" heating element while the second heating element 12B is ON and the third heating element 12C is OFF. During a second time interval T2 from t1 to t2 having the same duration as the first time interval T1, the second heating element 12B is operated as a "switched" heating element while the third heating element 12C is ON and the first heating element 12A is OFF. During a third time interval T3 from t2 to t3 having the same duration as the first time interval T1, the third heating element 12C is operated as a "switched" heating element while the first heating element 12A is ON and the second heating element 12B is OFF. Thus, at all times there is one heating element which is operated as a "switched" heating element, one heating element which is ON, and one heating element which is OFF, but the identity of these elements is rotated. On average over the time interval T1+T2+T3 from t0 to t3, each heating element 12A, 12B, 12C is operated as a "switched" heating element during 33.3% of the time, is ON during 33.3% of the time, and is OFF during 33.3% of the time, so that on a larger time scale all elements are treated equally.

FIG. 7C illustrates the operation of the heating elements 12A, 12B, 12C as a function of time in a situation where the required power is more than 2×Ptot/3 but less than Ptot (cf. FIG. 5C). During a first time interval T1 from t0 to t1, the first heating element 12A is operated as a "switched" heating element while the second and third heating elements 12B and 12C are ON. During a second time interval T2 from t1 to t2 having the same duration as the first time interval T1, the second heating element 12B is operated as a "switched" heating element while the first and third heating elements 12A and 12C are ON. During a third time interval T3 from t2 to t3 having the same duration as the first time interval T1, the third heating element 12C is operated as a "switched" heating element while the first and second heating elements 12A and 12B are ON. Thus, at all times there is one heating element which is operated as a "switched" heating element and two heating elements which are ON, but the identity of these elements is rotated. On average over the time interval T1+T2+T3 from t0 to t3, each heating element 12A, 12B, 12C is operated as a "switched" heating element during 33.3% of the time and is ON during 66.6% of the time, so that on a larger time scale all elements are treated equally.

It is noted that a function may be "rotated", meaning that the function of the first heating element is always transferred to the second one, while the function of the second heating element is always transferred to the third one, etc., while the function of the last heating element is always transferred to the first one. The order of such a transfer may be kept constant at all times, but it is also possible that the order of transfer is changed later. Said "second" heating element may physically be adjacent to said "first" heating element, but it is also possible that one or more heating elements are located between a pair of "first" and "second" heating elements.

In any case, the time intervals T1, T2, T3 as discussed above will be indicated as "operational status periods", and the transition from one operational status period (such as T1) to the next (such as T2) will be indicated as a "status transition".

Although the duration of the operational status periods is not critical in principle, this duration should preferably be chosen to be not too long, in order to prevent that the system is thermally unbalanced while the unbalance is rotated. In order to prevent the system from reaching a seriously unbalanced condition, the duration of the operational status period is preferable chosen to be shorter than the main thermal time constant of the system, more preferably shorter than 0.1 times the main thermal time constant of the system; such a main thermal time constant typically being of the order of 5 to 10 seconds.

On the other hand, the freedom of choosing a value for the duration of the operational status periods may be limited by the type of switching control operated on the heating elements. If power reduction is achieved by variable phase cutting in each current half-wave, a status transition may in principle be executed after each current half-wave. If power reduction is achieved by a multi-cycle burst technique, involving time frames TF of recurring multi-cycle burst patterns, a status transition should in general only be executed after having completed a full time frame, so that the duration of the operational status periods is then equal to n times TF, n being an integer greater than or equal to 1.

It should be clear to those skilled in the art that the present invention is not limited to the exemplary embodiments discussed above, but that several variations and modifications are possible within the protective scope of the invention as defined in the appended claims.

For example, instead of all being powered by the same power lines 21, 22, the heating elements may be powered from different sources, for example different phases of a 3-phase mains.

In the embodiment discussed with reference to FIGS. 7A-C, furthermore, the heating elements are operated in the order ON-SWITCHED-OFF; alternatively, they may be operated in the order OFF-SWITCHED-ON.

In the above examples, furthermore, the invention is explained for a case where reducing the power of a heating element is achieved by operating this heating element as a switched element according to the multi-cycle burst technique. It is to be noted that the present invention is not limited to this technique, although this technique is indeed preferred.

It is alternatively possible, for example, to perform a phase cutting technique (a heating element is switched ON after a zero-crossing of the current) and/or a phase cutting-out technique (a heating element is switched OFF before a zero-crossing of the current), as will be known to those skilled in the art.

It is assumed in the above examples, furthermore, that the heating elements are mutually substantially identical, so that their individual heating powers are mutually substantially equal. Indeed, this is preferred, in which case tolerances leading to differences of the order of 50 W may be considered acceptable. Nevertheless, it is to be noted that the present invention is not limited to the situation of substantially identical heating elements. A designer may deliberately choose differently rated heating elements, considering that this may offer an additional degree of operational freedom, albeit at the cost of a somewhat more complicated controller 30.

In an embodiment having precisely two mutually identical heating elements, for example, borderline control with no heating element being operated as a switched element can only be performed at a requested power of 0%, 50%, or 100% of Ptot, i.e. only three settings. If, however, a first element has a power rating P1 and a second element a power rating P2=2× P1, then borderline control can be performed in any of the four settings of a requested power of 0%, 33%, 67%, and 100% of Ptot. Furthermore, the distances between possible power settings are smaller in the case of multi-cycle burst control in the range from 0% to 33% of Ptot than they are in an embodiment in which the two heating elements are mutually identical. The same applies to the range from 67% to 100% of Ptot. In such a case, the operational status periods may be given mutually different durations for obtaining a thermally balanced system, as should be clear to those skilled in the art having knowledge from the above.

More generally, a first element may thus have a power rating P1=$\alpha$·Ptot and a second element may have a power rating P2=(1−$\alpha$)·Ptot, with $0<\alpha<1$. Likewise, in an embodiment having precisely three heating elements, a first element may have a power rating P1=$\alpha$·Ptot, a second element may have a power rating P2=$\beta$·Ptot, and a third element may have a power rating P3=$\gamma$·Ptot, with $\alpha+\beta+\gamma=1$. Further elaboration for an embodiment having four or more elements should be clear to those skilled in the art.

In the above, the present invention has been explained with reference to block diagrams which illustrate functional blocks of the device according to the present invention. It is to be understood that one or more of these functional blocks may be implemented in hardware, where the function of such a functional block is performed by individual hardware components, but it is also possible that one or more of these functional blocks are implemented in software, so that the function of such a functional block is performed by one or more program lines of a computer program or a programmable device such as a microprocessor, microcontroller, digital signal processor, etc.

The invention claimed is:

1. A method of operating a flow-through heating system comprising at least two heating elements in heat-transferring contact with one segment of a flow tube of a flow-through heating system, each individual heating element having a power rating, the method comprising the step of:

operating said heating system at a required power less than the power capacity of said heating system by operating precisely one of said at least two heating elements at reduced power (i.e. between zero power and full power) while the remaining heating elements of said at least two are either operated at full power or at zero power, wherein said heating system has a power capacity Ptot, wherein the total number of heating elements is equal to two, wherein a first heating element has a power rating P1=$\alpha$·Ptot and a second heating element has a power rating P2=(1$\alpha$)·Ptot, with $0<\alpha<1$, and wherein said heating system is operated at a required power (Pr) between zero and $\alpha$·Ptot by operating said first heating element at reduced power at least during a certain first time interval having a predetermined length, while said second heating element is operated at zero power.

2. The method as claimed in claim 1, wherein said second heating element is operated at reduced power after said first time interval has passed, while said first heating element is operated at zero power at least for the duration of a second time interval.

3. The method as claimed in claim 2, wherein $\alpha$ is at least approximately equal to 0.5 and wherein said second time interval has a duration equal to the duration of said first time interval.

4. A method of operating a flow-though heating system comprising at least two heating elements in heat-transferrin contact with one segment of a flow tube of a flow-through heating system, each individual heating element having a power rating, the method comprising the step of:

operating said heating system at a required power less than the power capacity of said heating system by operating precisely one of said at least two heating elements at reduced power (i.e. between zero power and full power) while the remaining heating elements of said at least two are either operated at full power or at zero power, wherein said heating system has a power capacity Ptot, wherein the total number of heating elements is equal to two, wherein a first heating element has a power rating P1=$\alpha$·Ptot and a second heating element has a power rating P2=(1 $\alpha$)·Ptot, with $0<\alpha<1$, and wherein said heating system is operated at a required power (Pr) between $\alpha$·Ptot and the power capacity Ptot by operating said second heating element at reduced power at least during a certain first time interval having a predetermined length, while said first heating element is operated at full power.

5. The method as claimed in claim 4, wherein said first heating element is operated at reduced power after said first time interval has passed, while said second heating element is operated at full power at least for the duration of a second time interval.

6. The method as claimed in claim 5, wherein $\alpha$ is at least approximately equal to 0.5, and wherein said second time interval has a duration equal to the duration of said first time interval.

7. A method of operating a flow-through heating system comprising at least two heating elements in heat-transferring contact with one segment of a flow tube of a flow-through heating system, each individual heating element having a power rating, the method comprising the step of:

operating said heating system at a required power less than the power capacity of said heating system by operating precisely one of said at least two heating elements at reduced power (i.e. between zero cower and full power) while the remaining heating elements of said at least two are either operated at full power or at zero power, wherein said heating system has a power capacity Ptot, wherein the total number of heating elements is equal to three, wherein a first heating element has a power rating P1=α·Ptot, wherein a second heating element has a power rating P2=β·Ptot, wherein a third heating element has a power rating P3=γ·Ptot, with α+β+γ=1;

and wherein said heating system is operated at a required power (Pr) between zero and α·Ptot by operating said first heating element at reduced power at least during a certain first time interval having a predetermined length, while the second and third heating elements are operated at zero power.

8. The method as claimed in 7, wherein said second heating element is operated at reduced power after said first time interval has passed, while said third heating element is operated at zero power and said first heating element is operated at zero power at least for the duration of a second time interval.

9. The method as claimed in claim 8, wherein α=β and wherein said second time interval has a duration equal to the duration of said first time interval.

10. The method as claimed in claim 8, wherein said third heating element is operated at reduced power after said second time interval has passed, while said second heating element is operated at zero power and said first heating element is operated at zero power at least for the duration of a third time interval.

11. The method as claimed in claim 10, wherein α=β=γ, and wherein said third time interval has a duration equal to the duration of said first time interval.

12. A method of operating a flow-through heating system comprising at least two heating elements in heat-transferring contact with one segment of a flow tube of a flow-through heating system, each individual heating element having a power rating, the method comprising the step of:

operating said heating system at are required power less than the power capacity of said heating system by operating precisely one of said at least two heating elements at reduced power (i.e. between zero power and full power) while the remaining heating elements of said at least two are either operated at full power or at zero power, wherein said heating system has a power capacity Ptot, wherein the total number of heating elements is equal to three, wherein a first heating element has a power rating P1=α·Ptot, wherein a second heating element has a power rating P2=β·Ptot, wherein a third heating element has a power rating P3=γ·Ptot, with α+β+γ=1;

and wherein said heating system is operated at a required power between α·Ptot and (α+β)·Ptot by operating said second heating element at reduced power at least during a certain first time interval having a predetermined length, while said first heating element is operated at full power and said third heating element is operated at zero power.

13. The method as claimed in claim 12, wherein said first heating element is operated at reduced power after said first time interval has passed, while said third heating element is operated at full power and said second heating element is operated at zero power at least for the duration of a second time interval.

14. The method as claimed in claim 13, wherein said third heating element is operated at reduced power after said second time interval has passed, while said first heating element is operated at zero power and said second heating element is operated at full power at least for the duration of a third time interval.

15. The method as claimed in claim 14, wherein α=β=γ and wherein the first, second, and third time intervals have mutually equal durations.

16. The method as claimed in claim 12, wherein said third heating element is operated at reduced power after said first time interval has passed, while said first heating element is operated at zero power and said second heating element is operated at full power at least for the duration of a second time interval.

17. The method as claimed in claim 16, wherein said first heating element is operated at reduced power after said second time interval has passed, while said third heating element is operated at full power and said second heating element is operated at zero power at least for the duration of a third time interval.

18. The method as claimed in claim 17, wherein α=β=γ and wherein the first, second, and third time intervals have mutually equal durations.

19. A method of operating a flow-through heating system comprising at least two heating elements in heat-transferring contact with one segment of a flow tube of a flow-through heating system, each individual heating element having a power rating, the method comprising the step of:

operating said heating system at a required power less than the power capacity of said heating system by operating precisely one of said at least two heating elements at reduced power (i.e. between zero power and full power) while the remaining heating elements of said at least two are either operated at full power or at zero power, wherein said heating system has a power capacity Ptot, wherein the total number of heating elements is equal to three, wherein a first heating element has a power rating P1=α·Ptot, wherein a second heating, element (12B) has a power rating P2=β·Ptot, and wherein a third element has a power rating P3=γ·Ptot, with α+β+γ=1;

and wherein said heating system is operated at a required power between (α+β)·Ptot and the full power capacity of said heating system by operating said first said heating element at reduced power at least during a certain first time interval having a predetermined length, while the second and third heating elements are operated at full power.

20. The method as claimed in claim 19, wherein, after said first time interval has passed, said second heating element is operated at reduced power at least during a certain first time interval having a predetermined length, while said third heating element is operated at full power and said first heating element is operated at full power at least for the duration of a second time interval.

21. The method as claimed in claim 20, wherein said third heating element is operated at reduced power after said second time interval has passed, while said second heating element is operated at full power and said first heating element is operated at full power at least for the duration of a third time interval.

22. The method as claimed in claim 21, wherein α=β=γ and wherein the first, second, and third time intervals have mutually equal durations.

23. A flow-through heating system comprising:

a flow tube;

at least two heating elements in heat-transferring contact with one segment of the flow tube, each heating element being connected in series with a respective corresponding controllable switch; and a control unit having control outputs coupled, respectively, to control inputs of the controllable switches;

wherein the control unit generates control signals for opening and closing the respective controllable switches so as to implement the method as claimed in claim 1.

24. An appliance for dispensing a liquid comprising the system as claimed in claim 23.

* * * * *